United States Patent [19]

Bejnar

[11] Patent Number: 4,961,975

[45] Date of Patent: Oct. 9, 1990

[54] SEALED GLASS UNIT

[76] Inventor: Walter Bejnar, 332 Oxbow Crescent, Ontario, Mississauga, Ontario, Canada, L4Z 2S3

[21] Appl. No.: 270,593

[22] Filed: Nov. 14, 1988

[51] Int. Cl.[5] ..... E06B 5/00

[52] U.S. Cl. ..... 428/34; 428/81; 428/83; 428/192; 156/109; 52/788; 52/790

[58] Field of Search ..... 428/34, 192, 83, 119, 428/81; 156/107, 109; 52/171, 172, 788–790

[56] References Cited

U.S. PATENT DOCUMENTS

| | | | |
|---|---|---|---|
| 3,054,153 | 9/1962 | Partsch | 52/788 |
| 4,552,790 | 10/1985 | Francis | 428/34 |
| 4,669,241 | 6/1987 | Kelly | 52/400 |

*Primary Examiner*—Thurman K. Page
*Assistant Examiner*—Donald J. Loney

[57] ABSTRACT

A sealed glass unit comprising a pair of spaced glass window panes and a sealing frame assembly between the glass panes and extending therearound adjacent edges thereof to maintain the glass panes in sealed spaced parallel relationship. The sealing frame assembly has elongated spacers means extending around and between the glass panes in laterally inwardly spaced relationship from their edges to maintain the glass panes in spaced parallel relationship. Elongated connectors extending longitudinallly at least partway around the glass panes. Each elongated connector has an elongated body extending laterally between the glass panes in spaced relationship thereto from a first location aligned with the edges thereof to a second location spaced from the spacer. Each elongated connector also has opposed flanges extending in opposite directions from the body and extending at least partway across the glass pane edges in spaced relationship thereto. Structural sealant compound fully occupies the spaces between the elongated connector body and the glass panes, between the elongated connector body and the elongated spacer and between the connector flanges and the glass pane edges.

6 Claims, 3 Drawing Sheets

SEALED GLASS UNIT

This invention relates to sealed glass units, that is to say prefabricated windows comprising a pair of spaced glass window panes maintained in sealed spaced parallel relationship by a sealing frame assembly between the glass panes and extending therearound adjacent their edges.

For modern buildings, sealed glass units have to be capable of conforming to many strict requirements, for example the need to have a long working life while being subjected to varying weather conditions as well as being reasonable in cost and capable of easy installation. Many different sealed glass unit constructions have been proposed in the past, for example as in U.S. Pat. No. 4,552,790 (Francis) issued Nov. 12, 1985, but there is still a need for a sealed glass unit construction which more satisfactorily conforms to the above mentioned requirements.

According to the present invention, a sealing frame assembly for a sealed glass unit comprises elongated spacer means extending around and between the glass panes in laterally inwardly spaced relationship from their edges to maintain the glass panes in spaced parallel relationship. Elongated connector means extend longitudinally at least partway around the glass panes, the elongated connector means comprising elongated body means extending laterally between the glass panes in spaced relationship thereto from a first location aligned with the edges thereof to a second location spaced from the spacer means, the elongated connector means also having opposed flanges extending in opposite directions from the body means and extending at least partway across the glass pane edges in spaced relationship thereto. Structural sealant compound fully occupies the space between the elongated connector body means and the glass panes, between the elongated body means and the elongated spacer means and between the connector flanges and the glass pane edges.

Sealed glass units in accordance with the invention are easy to manufacture, and the positioning of the structural sealant compound in accordance with the invention provides a very effective seal. Good strength against wind pressure is also provided. Also, the edges of the glass panes are protected by the connector flanges.

The elongated connector body means may have a generally U-shaped section with a laterally outwardly facing open end from which the flanges extend in opposite directions and a laterally inwardly facing closed end adjacent the spacer means.

Alternatively, elongated connector body means may have a hollow closed section with attachment means extending from a laterally outer end thereof. The attachment means may be T-shaped. As another alternative, the elongated connector body means may have a generally U-shaped section with a laterally outwardly facing closed end from which the flanges extend and with a laterally inwardly facing open end adjacent the spacer means. The laterally outwardly facing closed end may be provided with T-shaped attachment means.

Embodiments of the invention will now be described, by way of example, with reference to the accompanying drawings, of which:

Figure 1:
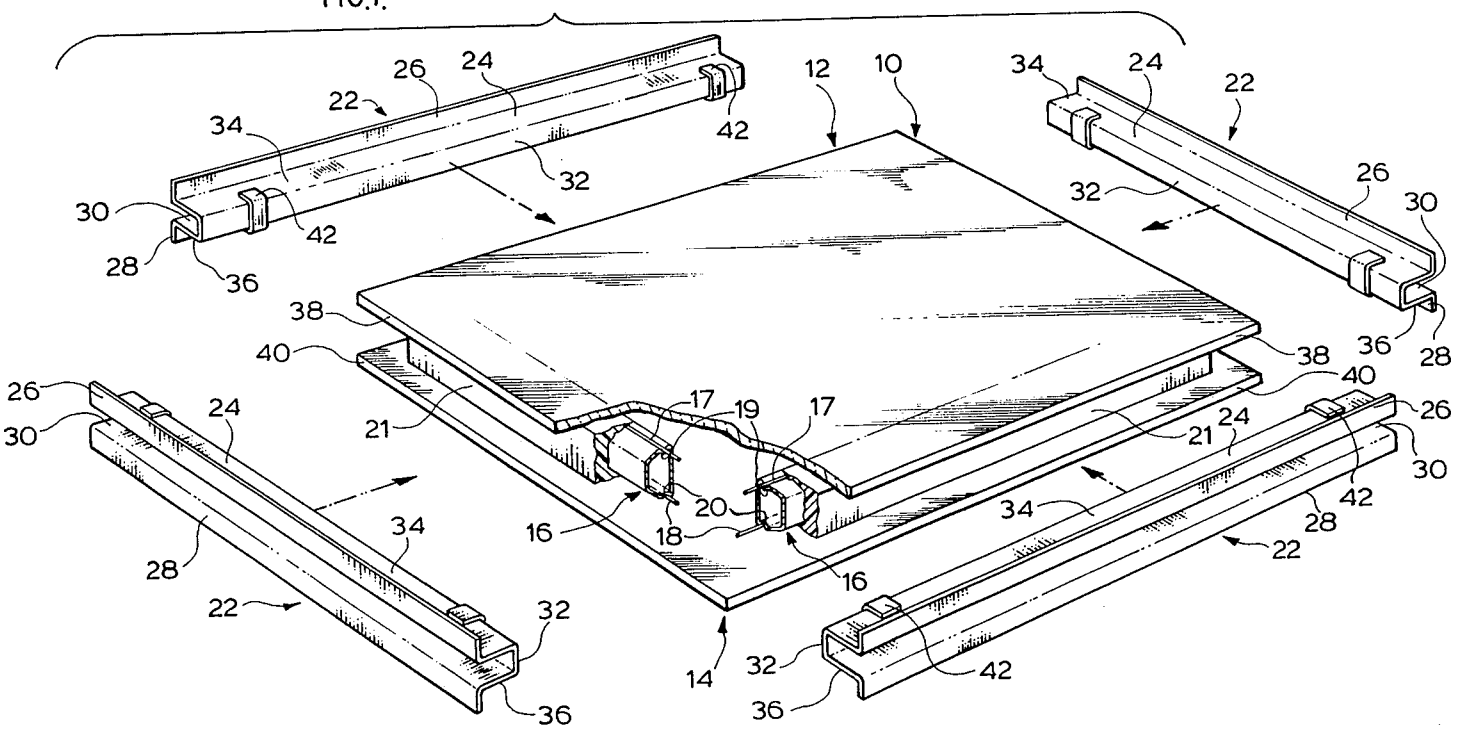
FIG. 1 is an exploded perspective view, partly broken away, showing one stage during the assembly of a sealed glass unit in accordance with one embodiment of the invention.

Referring first to FIG. 1 of the accompanying drawings, a sealed glass unit 10 includes a pair of parallel spaced rectangular glass panes 12, 14. Elongated spacer means is formed by four elongated hollow spacers 16 of known kind fabricated from light metal or synthetic plastic material extending around and between the glass panes 12, 14 in laterally inwardly spaced relationship from their edges to maintain the glass panes 12, 14 in spaced parallel relationship. Elongated sealing strips 17, 18 of suitable elastomeric material seated in grooves 19, 20 in the top and bottom respectively of the spacers 16 form a primary seal between the inner space between the glass panes 12, 14 and the exterior. Elongated spacers 16 may in known manner contain a dessicant and be provided with apertures (not shown) in their innermost walls such that the dessicant absorbs any moisture in the inner space between the glass panes 12, 14.

During construction of the sealed glass units 10, spacers 16 and sealing strips 17, 18 are positioned between the glass panes 12, 14 at a distance from their edges to form a rectangular spacer frame. The space between the glass frames 12, 14 from the spacer 16 to about half the distance to the edges of the glass panes 12, 14 is then filled with a structural silicone sealant 21 of any suitable known kind.

Four elongated connectors 22 are then pushed into the silicone sealant 21 to form elongated connector means extending longitudinally around the glass panes 12, 14. Each connector 22 has a generally U-shaped body 24 with flanges 26, 28 extending in opposite directions from the open end 30 of the body 24. The width of the U-shaped body 24 is somewhat less than the spacing between the glass panes 12, 14. The closed end 32 of the U-shaped body 24 of its connector 22 is pushed into the structural silicone sealant 21 to displace the silicone sealant 21 around opposite sides 34, 36 of the connector body 24. The pushing in of each connector 22 is continued until the flanges 26, 28 are nearly in engagement with the edges 38, 40 of the glass panes, 12, 14 and the closed end 32 of the connector body 24 is still spaced from the respective spacer 16. The length of the flanges 26, 28 is such that they partially overlap the glass pane edges 38, 40.

To ensure that the connectors 22 are correctly aligned with respect to the glass panes 12, 14, each connector 22 is provided with a pair of auxiliary U-shaped silicon extruded spacers 42 which fit over the U-shaped body 24 from the closed end 32 thereof and engage the inner faces of the glass panes 12, 14.

During the pushing in of a connector 22, the structural silicone sealant 21 is forced around the connector body 24 and into the spaces between the connector flanges 26, 28 and the glass pane edges 38, 40. The silicone sealant 21 thus then fills the space between the closed end 32 of each connector body 24 and the respective spacer 26, the space between the opposite sides 34, 36 of each connector body 24 and the glass panes 12, 14, and the space between the connector flanges 26, 28 and the glass pane edges 38, 40 (see FIG. 3). The amount of silicone sealant used is arranged to be slightly greater than that required to fill such spaces, so that the excess will be forced out of the unit beyond the flanges 26, 28 and can thus be removed.

The structural silicone sealant 21, besides acting as a sealant, also acts as a continuous setling block at the bottom of the sealed glass unit for dead load support, i.e. for supporting the weight for the unit itself.

Figure 2:
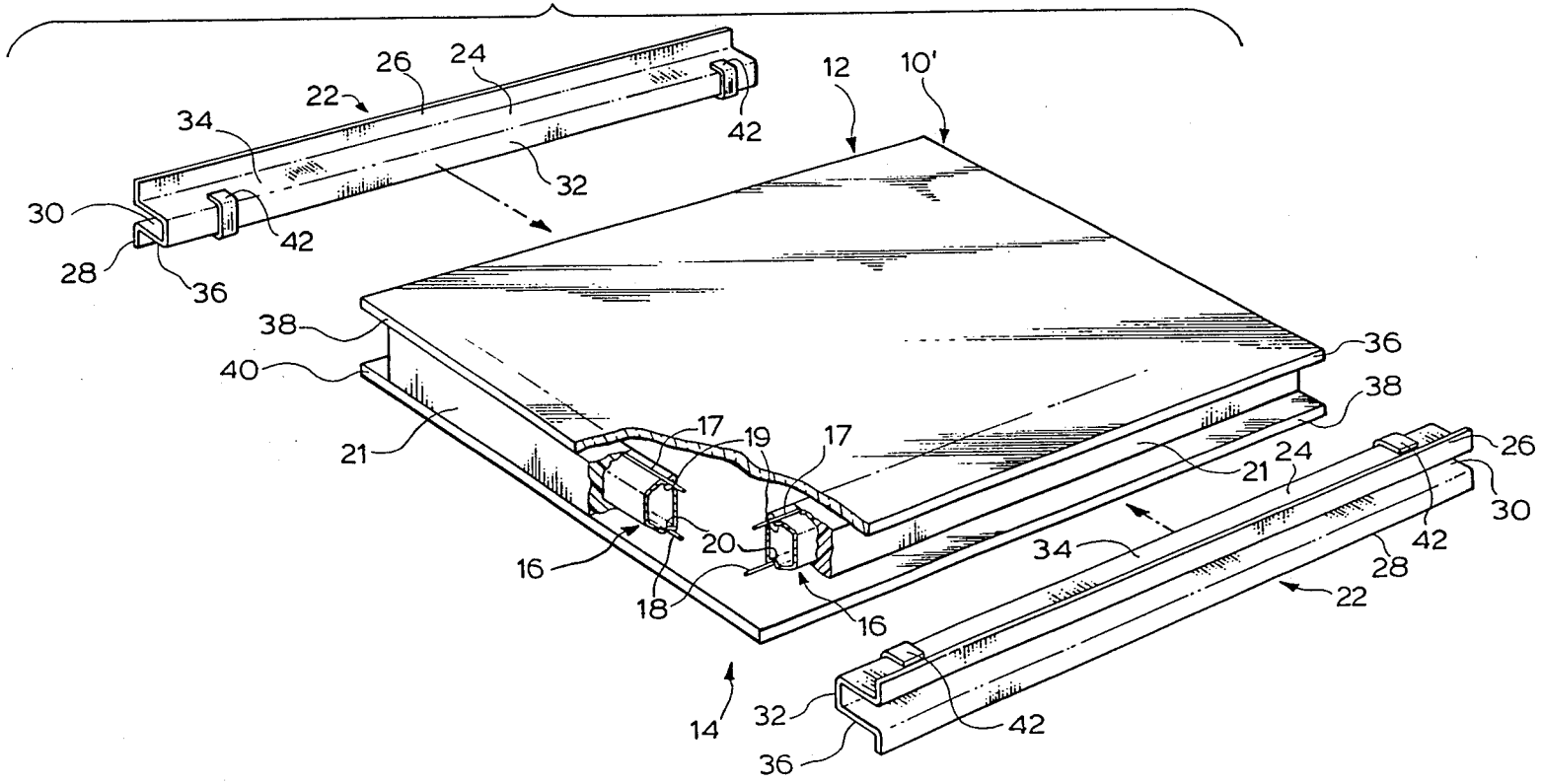
FIG. 2 is a similar view of another embodiment of the invention.

In sealed glass unit 10 of FIG. 1, four connectors 22 were provided, i.e. one for each pair of edges 38, 40 of the glass panes 12, 14. FIG. 2 shows an alternative sealed glass unit 10 in which connectors 22 are provided only at opposite side edges of the glass panes 12, 14, i.e. the sides which will be vertical in use. At the top and bottom edges, the spacers 16 are positioned near the edges so that the silicone sealant 21 is flush with the edges 38, 40 (instead of half-way thereto as when connectors 22 are to be fitted).

Figure 3:
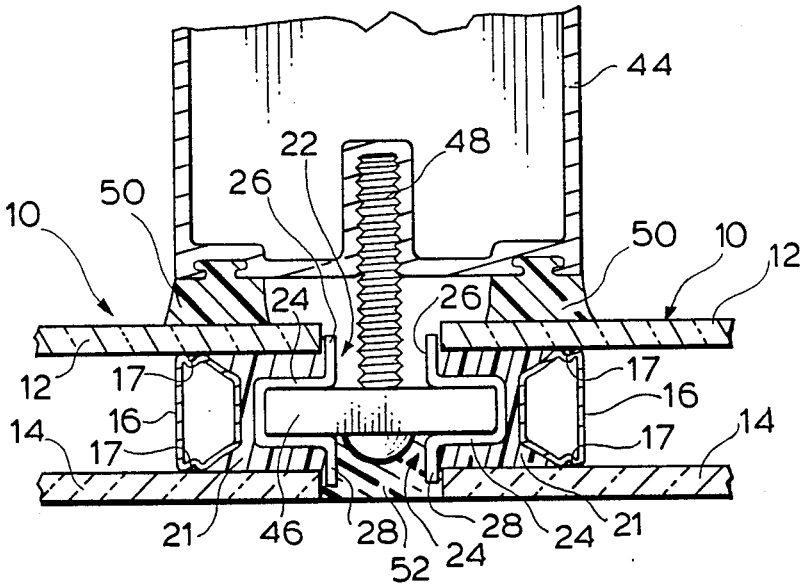
FIG. 3 is a sectional view showing two sealed glass units in accordance with the embodiment of FIG. 1 or FIG. 2 connected to a support member.

FIG. 3 is a sectional view showing one manner in which two side by side laterally spaced sealed glass units of the kind shown in either FIG. 1 or FIG. 2 can be secured to a support member 44. Opposite sides of an elongated connector bar 46 are slid into opposed U-shaped connector bodies 24 of the two sealed glass units 10 and the connector body 46 is secured by a series of longitudinally spaced screws 48 to the support member 44, with sealing strips 50 being positioned between the panes and the support member 44. The space between the outer panes 14 can be filled with sealing compound 52.

Figure 4:
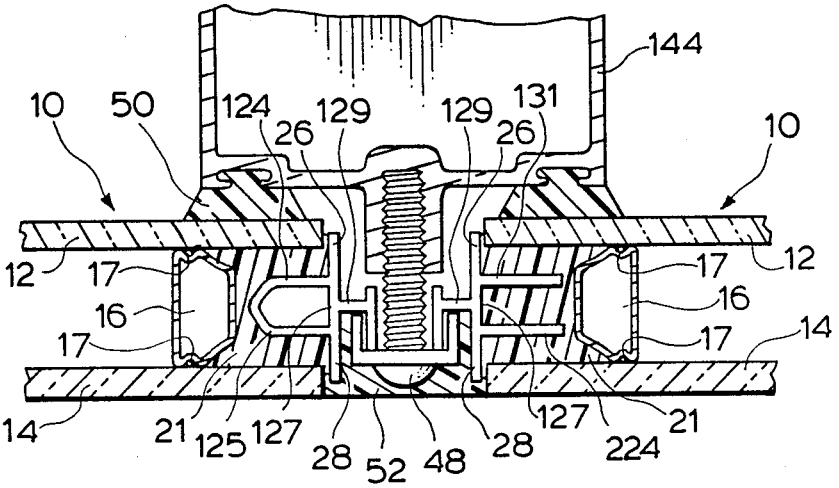
FIG. 4 is a side view showing two sealed glass units in accordance with further embodiments of the invention connected to a support member.

FIG. 4 shows two alternative types of connector. Connector 124 on the left has an elongated connector body 125 of hollow closed section, with an end wall 127 co-planar with the flanges 26, 28, and a T-shaped attachment member 129 extending laterally outwardly therefrom. The connector 224 on the right also has an end wall 127 and T-shaped attachment member 129, but the connector body 131 is of generally U-shaped section open at the rear end adjacent the spacer 16. Screws 48 pass through a U-shaped connector bar 146 into the support member 144, the connector bar 146 engaging the T-shaped attachment members 129 of the connectors 124, 224.

A person skilled in the art will readily appreciate the advantages of the above described embodiments. The sealed glass units are easy to manufacture, and the edges 38, 40 of the glass panes 12, 14 are protected by the connector flanges 26, 28. Further, the seal provided by the structural silicone sealant 21 in accordance with the invention is especially effective, both as a seal against air and water and as a structural adhesive. The sealant 21 extends deeper into the glass unit in the present invention than in most prior art units.

Other advantages of the invention will also be readily apparent to a person skilled in the art, the scope of the invention being defined in the appended claims.

I claim:

1. A sealed glass unit comprising a pair of spaced glass window panes and a sealing frame assembly between the glass panes and extending therearound adjacent edges thereof to maintain the glass panes in sealed spaced parallel relationship, said sealing frame assembly comprising elongated spacer means extending around and between the glass panes in laterally inwardly spaced relationship from their edges to maintain the glass panes in said spaced parallel relationship, elongated connector means extending longitudinally at least partway around the glass panes, said elongated connector means comprising elongated body means extending laterally between the glass panes in spaced relationship thereto from a first location aligned with the edges thereof to a second location spaced from the spacer means, and said elongated connector means also having opposed connector flanges extending in opposite directions from the body means and extending at least partway across said glass pane edges in spaced relationship thereto, and structural sealant compound fully occupying the spaces between the elongated connector body means and the glass panes, between the elongated connector body means and the elongated spacer means and between the connector flanges and the glass pane edges.

2. A sealed glass unit according to claim 1 wherein the elongated connector body means has a generally U-shaped section with a laterally outwardly facing open end from which said flanges extend in opposite directions, and a laterally inwardly facing closed end adjacent the spacer means.

3. A sealed glass unit according to claim 1 wherein the elongated connector body means has a hollow closed section with attachment means extending from a laterally outer end thereof.

4. A sealed glass unit according to claim 3 wherein the attachment means is T-shaped.

5. A sealed glass unit according to claim 1 wherein the elongated connector body means has a generally U-shaped section with a laterally outwardly facing closed end from which said flanges extend, and with a laterally inwardly facing open end adjacent the spacer means.

6. A sealed glass unit according to claim 5 wherein T-shaped attachment means extends from the laterally outwardly facing closed end of the body means.

* * * * *